US008907223B2

(12) United States Patent
Johansson et al.

(10) Patent No.: US 8,907,223 B2
(45) Date of Patent: Dec. 9, 2014

(54) BUSHINGS FOIL DESIGN

(71) Applicants: Kenneth Johansson, Taby (SE); Robert Stahl, Ludvika (SE)

(72) Inventors: Kenneth Johansson, Taby (SE); Robert Stahl, Ludvika (SE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 14/139,399

(22) Filed: Dec. 23, 2013

(65) Prior Publication Data

US 2014/0110151 A1 Apr. 24, 2014

Related U.S. Application Data

(63) Continuation of application No. PCT/EP2012/056791, filed on Apr. 13, 2012.

(30) Foreign Application Priority Data

Jun. 28, 2011 (EP) ..... 11171646

(51) Int. Cl.
*H01B 17/28* (2006.01)

(52) U.S. Cl.
CPC ..... *H01B 17/28* (2013.01)
USPC ..... 174/143

(58) Field of Classification Search
CPC ..... H01B 17/28
USPC ..... 174/28, 143, 152 R, 142, 17 LF, 31 R; 361/313
See application file for complete search history.

(56) References Cited

FOREIGN PATENT DOCUMENTS

| | | | |
|---|---|---|---|
| EP | 2093777 | A1 | 8/2009 |
| EP | 2180485 | A1 | 4/2010 |
| WO | 2006001724 | A1 | 1/2006 |

OTHER PUBLICATIONS

European Search Report Application No. EP 11 17 1646 Completed: Oct. 28, 2011 5 pages.
International Search Report & Written Opinion of the International Searching Authority Application No. PCT/EP2012/056791 Completed: May 10, 2012; Mailing Date: May 18, 2012 8 pages.

*Primary Examiner* — Timothy Thompson
*Assistant Examiner* — Charles Pizzuto
(74) *Attorney, Agent, or Firm* — St. Onge Steward Johnston & Reens LLC

(57) ABSTRACT

A lead-trough device for an electrical conductor, which structure includes an insulating body arranged for housing the electrical conductor along a central axis of the insulating body. Further, the lead-trough structure includes insulating layers and conducting layers arranged on the inside of the insulating body, which insulating layers and conducting layers are concentrically wrapped around the central axis of the body and alternatingly arranged along a transaxial direction of the insulating body. At least one conducting layer is wrapped concentrically around the central axis of the body for less than 360° such that ends of the at least one conducting layer are spaced apart.

13 Claims, 5 Drawing Sheets

BUSHINGS FOIL DESIGN

FIELD OF THE INVENTION

The present invention generally relates to improved bushings foil design.

BACKGROUND OF THE INVENTION

A bushing is a lead-trough structure via which a conductor can pass. Bushings are commonly used in transformers and other high voltage equipment. To obtain a well defined electrical field distribution inside and along a bushing, aluminum foils are wrapped in between paper insulation on the inside of the bushing to capacitively control the electrical field such that electrical field stress can be reduced and breakdown is avoided.

When the aluminum foil has been wrapped one turn around the inside of the bushing, i.e. when the foil has been wrapped for a full 360°, one end of the foil is applied another 10 to 100 mm to form an overlap with the other end of the foil with a paper insulation layer in between. This is illustrated in FIG. 2, where three pieces of aluminum foil have been wrapped inside the bushing with paper insulation layers arranged between each piece of aluminum foil.

The aluminum foil overlap area in the bushing has been identified as a problem since it effectively forms an electric resonance circuit that is excited by very fast transients (VFTs) which are caused by factors such as e.g. switching operations, faults and disturbances. These transients cause high overvoltages between the foils and occasionally lead to breakdowns in the bushings. In oil-impregnated paper bushings, this problem has been solved by short-circuiting every aluminum foil overlap by punching through both the two foils and the intermediate paper insulation with a sharp tool. When producing resin-impregnated paper bushings, it has not been possible to adapt this technique. The foil overlap has been used because it has been a common opinion that the edges of the foil cannot be exposed in the strong electrical field occurring during operation of the bushing.

SUMMARY OF THE INVENTION

A general object of the present invention is to solve or at least mitigate the above described problems in the art.

This object is attained in an aspect of the invention by a lead-trough device for an electrical conductor, which structure comprises an insulating body arranged for housing the electrical conductor along a central axis of the insulating body. Further, the lead-trough structure comprises insulating layers and conducting layers arranged on the inside of the insulating body, which insulating layers and conducting layers are concentrically wrapped around the central axis of the body and alternatingly arranged along a transaxial direction of said insulating body. At least one conducting layer is wrapped concentrically around the central axis of the body for less than 360° such that ends of the at least one conducting layer are spaced apart.

The present invention is advantageous in that a gap is created between the two ends of a conducting layer arranged inside the lead-trough structure instead of the foil overlap employed in the art.

First, the inventive conductive layer arrangement does not pick up as strong circulating current since no overlap is present.

Second, the resonance frequency of the inventive conductive layer arrangement has a much higher resonance frequency since the capacitive contribution of the overlap has disappeared. Higher frequencies are thus more attenuated and not as likely to excite with a VFT due to greater dielectric losses.

Third, insulation length between the ends of a conductive layer can be made greater with a gap than with an overlapping foil structure, where the insulation length is the distance between the two foils in the overlapping section. This reduces the risk of a bushing breakdown.

The conductive layers are formed of a material being sufficiently low in resistivity such that a resulting electric field can be controlled.

In an embodiment of the present invention, the conducting layer is an aluminum foil, or any other appropriate metal being shaped in a sheet-like structure such that it can be wrapped concentrically around the central axis of the lead-trough device, which typically is embodied in the form of a bushing.

In another embodiment, the conductive layers are embodied in the form of a coating arranged on insulation of the insulating body. The coated insulation is subsequently wrapped concentrically around the central axis of the lead-trough device such that the coating forms the conductive layers arranged in between the insulating layers. For example, the coating may be embodied in the form of conductive carbon-based paint which is printed onto the insulation, being for instance paper, during wrapping around the central axis.

In a further embodiment, the conducting layer is sheet-like structure of conductive material not necessarily being a metal. Many different variations are possible.

Additional features and advantages will be disclosed in the following.

BRIEF DESCRIPTION OF THE DRAWINGS

Embodiments of the present invention and advantages thereof will now be described by way of non-limiting examples, with reference to the accompanying drawings in which.

DETAILED DESCRIPTION OF THE INVENTION

Figure 1:
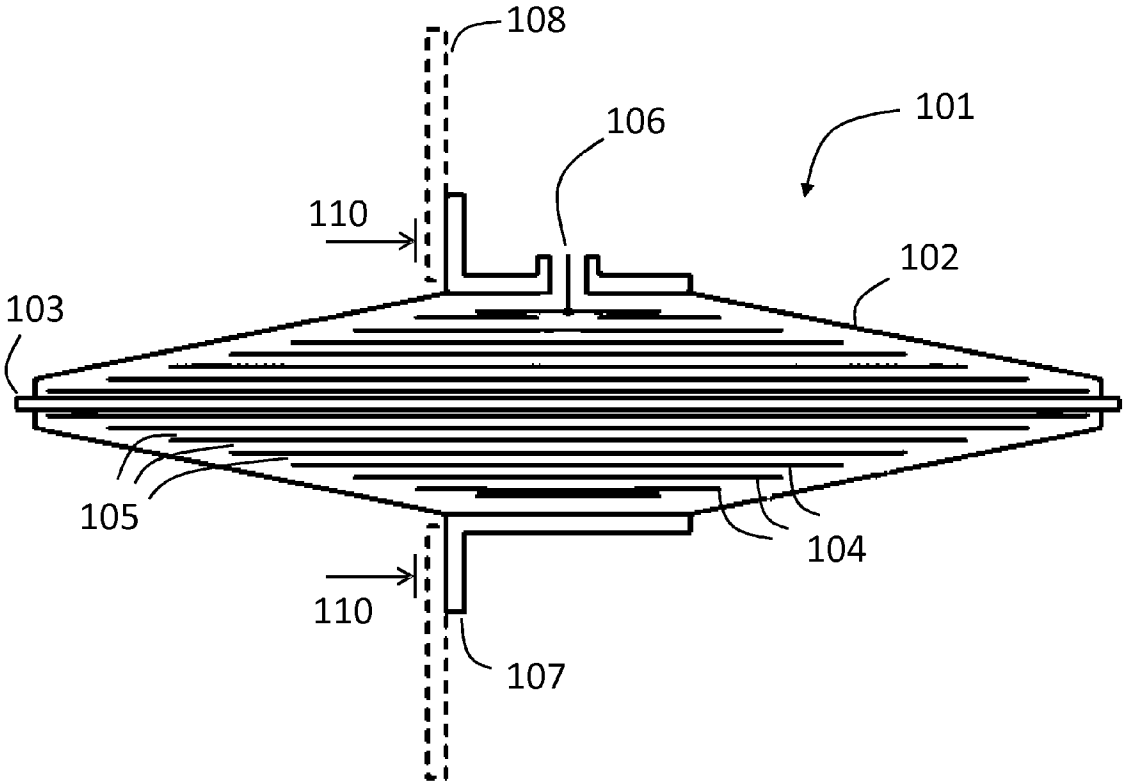
FIG. 1 shows a side view of a bushing in which the present invention can be applied.

FIG. 1 shows a side view of a bushing in which the present invention can be applied. The bushing 101 is comprised of an insulating body 102 formed by an outer insulating shell typically made of silicone rubber insulation, and a paper body housed by the outer shell. The paper body may be resin impregnated. An electrical conductor 103 can be inserted into the bushing along a central axis. Conducting foils 104 are concentrically wrapped around the central axis in between paper insulation 105 on the inside of the insulating body to obtain a well defined electrical field distribution inside and along the bushing.

The bushing may further comprise a test tap 106 for accessing the inside of the bushing in order to perform capacitance and voltage measurements. The bushing is typically coupled via a flange 107 to a transformer 108 such that energy can be transferred via the electrical conductor 103.

Figure 2:
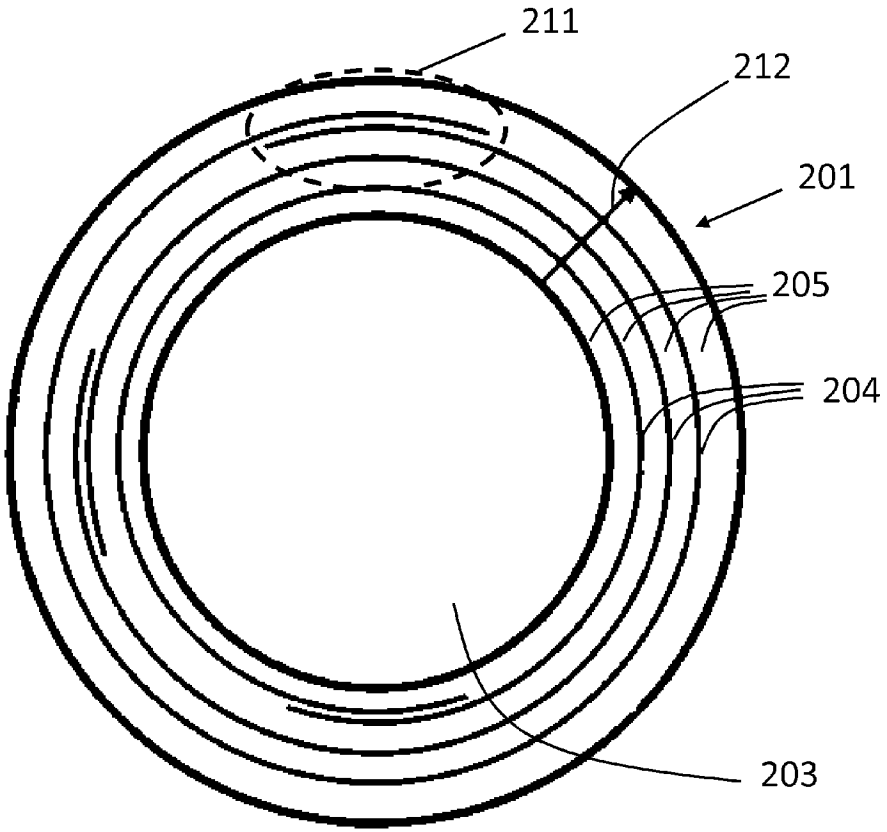
FIG. 2 Prior Art
FIG. 2 illustrates a cross-section of a prior art bushing, showing prior art wrapping of conducting foils.

FIG. 2 illustrates a cross-section of a prior art bushing, showing prior art wrapping of three layers of conducting foils 204. When the conducting foil has been wrapped one turn around the central axis 203 of the bushing 201, i.e. when the foil has been wrapped for a full 360°, one end of the foil is applied another 10 to 100 mm to form an overlap 211 with the other end of the foil with a paper insulation layer 205 in between. The insulating layers and conducting foils are concentrically wrapped around the central axis 203 of the bushing and alternatingly arranged along a transaxial direction 212 of the bushing. Disadvantages of this prior art overlap have been discussed in the above.

Figure 3:
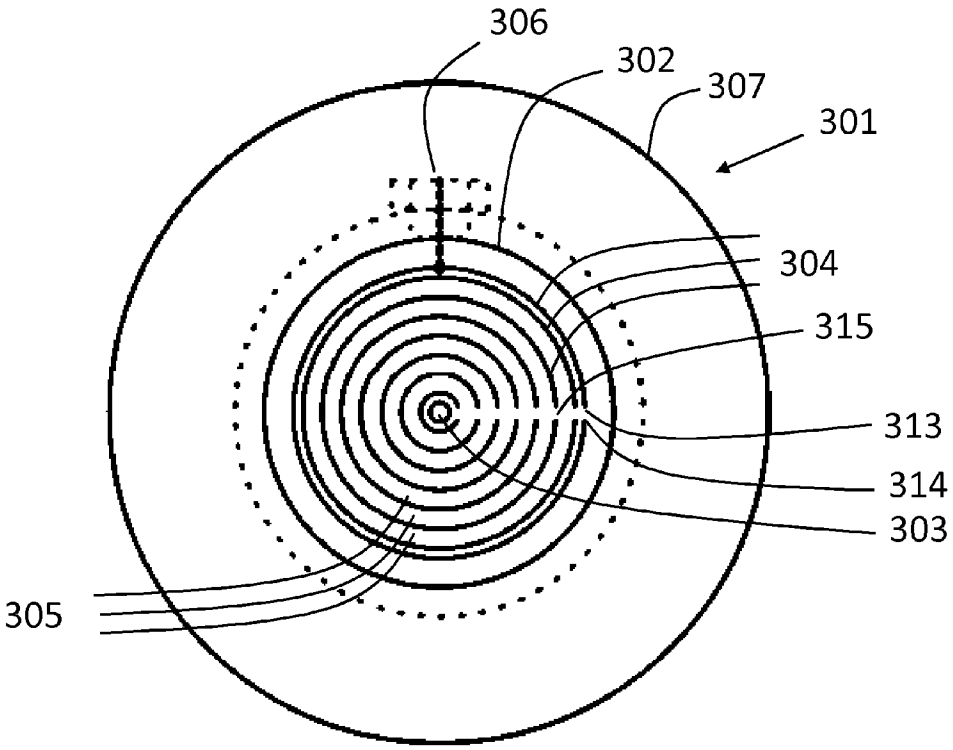
FIG. 3 is a cross-section of the bushing in FIG. 1 taken along line 110-110, showing wrapping of conducting foils in accordance with an embodiment of the present invention.

FIG. 3 is a cross-section of the bushing of FIG. 1 taken along line 110-110, showing wrapping of conducting layers 304 in accordance with an embodiment of the present invention. When wrapping the conducting layers 304 around the central axis 303 of the bushing 301 in this embodiment of the invention, each layer is wrapped less than 360°, such that ends 313, 314 of each conducting layer are spaced apart. Thus, a gap 315 is created between the two ends 313, 314 of a conducting layer wrapped inside the bushing. The insulating layers 305 and conducting layers 304 are concentrically wrapped around the central axis 303 on the inside of the insulating body 302 of the bushing and alternatingly arranged along a transaxial direction of the body such that each conducting layer is arranged with an insulating layer on each side. The bushing of the present invention may optionally comprise a test tap 306 and/or a flange 307. As can be seen in FIGS. 1 and 3, the conducting layers and the insulating layers may be formed like sheets extending along the length of the insulating body. As has been previously mentioned, coatings can alternatively be used to create the conducting layers, in which case the coatings are applied to the insulation of the bushing insulating body.

In FIG. 3, all conducting layers are wrapped such that a gap 315 is formed between the two ends of the respective layer. It is to be understood that not every conductive layer must be wrapped in this manner, but could be wrapped with an overlap as described in the above. However, the effects of the present invention as discussed hereinabove will be more apparent with a greater number of non-overlapping conducting layers.

Figure 4:
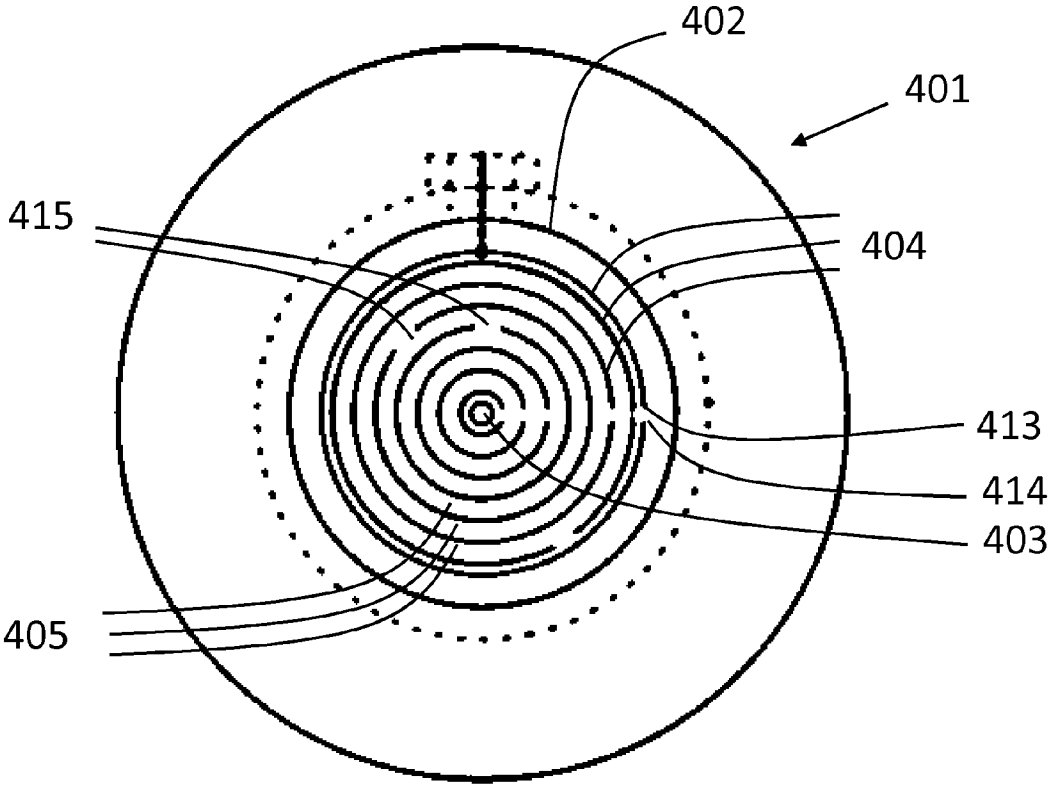
FIG. 4 is a cross-section of the bushing in FIG. 1 taken along line 110-110, showing wrapping of conducting foils in accordance with another embodiment of the present invention.

FIG. 4 is a cross-section of the bushing of FIG. 1 taken along line 110-110, showing wrapping of conducting foils 404 in accordance with another embodiment of the present invention. The insulating layers 405 and conducting layers 404 are concentrically wrapped around the central axis 403 on the inside of the insulating body 402 of the bushing and alternatingly arranged along a transaxial direction of the body such that each conducting layer is arranged with an insulating layer on each side. When wrapping the conducting layers 404 around the central axis 403 of the bushing 401 in this embodiment of the invention, each layer is wrapped less than 360°, such that ends 413, 414 of each conducting layer are spaced apart. Again, a gap is created between the two ends 413, 414 of a conducting layer arranged inside the bushing. However, in contrast to the embodiment shown in FIG. 3, the gaps 415 of FIG. 4 are not necessarily aligned along the same transaxial direction of the insulating body 402.

It is understood that the gaps created by the conducting layers may be of varying sizes. The gaps within one and the same bushing may further mutually be of different sizes.

Figure 5:
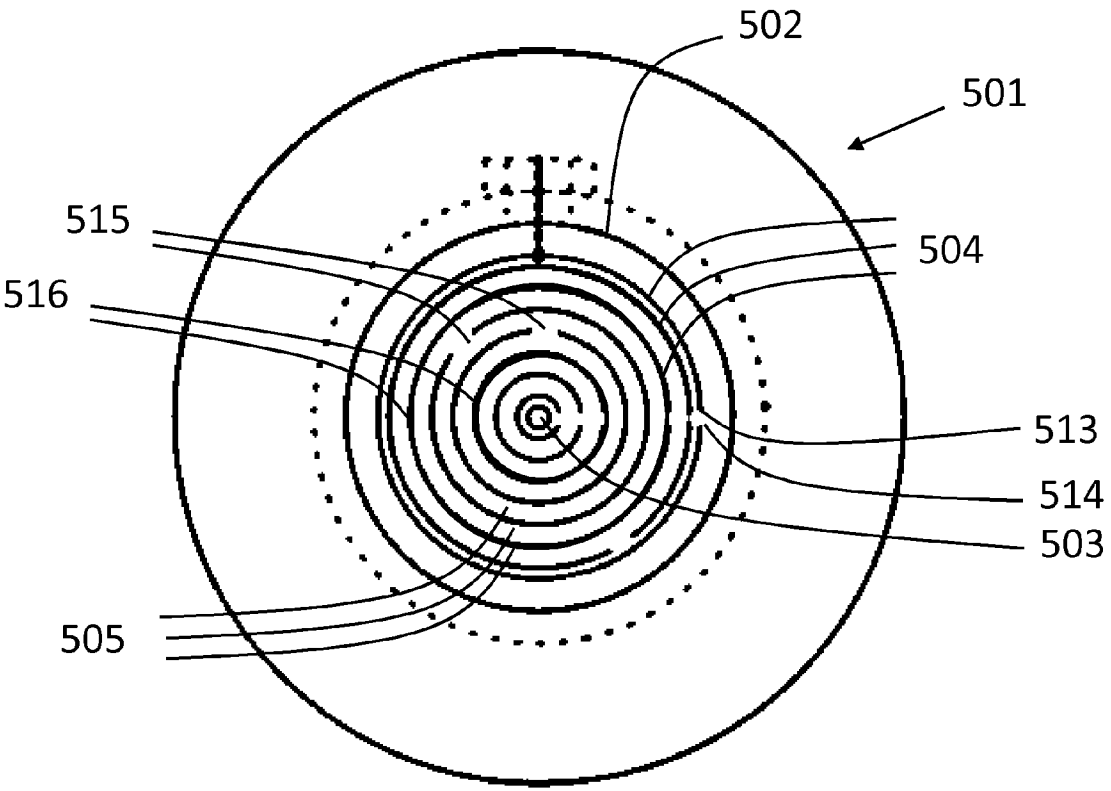
FIG. 5 is a cross-section of the bushing in FIG. 1 taken along line 110-110, showing wrapping of conducting foils in accordance with a further embodiment of the present invention.

FIG. 5 is a cross-section of the bushing of FIG. 1 taken along line 110-110, showing wrapping of conducting layers 504 in accordance with a further embodiment of the present invention. The insulating layers 505 and conducting layers 504 are concentrically wrapped around the central axis 503 on the inside of the insulating body 502 of the bushing and alternatingly arranged along a transaxial direction of the body such that each conducting layer is arranged with an insulating layer on each side. When arranging the conducting layers 504 around the central axis 503 of the bushing 501 in this embodiment of the invention, some conducting layers are wrapped less than 360°, such that ends 513, 514 of these conducting layers are spaced apart creating gaps 515 (aligned or non-aligned). However, in contrast to the embodiments of FIG. 3 or 4, some of the conducting layers arranged inside the insulating body 502 are short-circuited. In this particular illustration, two conducting layers 516 have been short-circuited. This embodiment is advantageous in that possible breakdown voltages occurring across the gaps 515 can be avoided.

The skilled person in the art realizes that the present invention by no means is limited to the examples described hereinabove. On the contrary, many modifications and variations are possible within the scope of the appended claims.

What is claimed is:

1. A lead-trough device for an electrical conductor, which structure comprises:

an insulating body arranged for housing an electrical conductor along a central axis of the insulating body, insulating layers and conducting layers arranged on the inside of said body, which insulating layers and conducting layers are concentrically wrapped around the central axis of the body, said insulating layers and conducting layers being alternatingly arranged along a transaxial direction of said insulating body, wherein at least one conducting layer is wrapped concentrically around the central axis of the body for less than 360° such that the two ends of said at least one conducting layer are spaced apart.

2. The lead-trough device according to claim 1, wherein the insulating layers and conducting layers are arranged to extend along the length of said insulating body.

3. The lead-trough device according to claim 1, said conductive layers being arranged to be formed of a material being sufficiently low in resistivity such that a resulting electric field can be controlled.

4. The lead-trough device according to claim 1, wherein the conducting layers comprises metal foils.

5. The lead-trough device according to claim 4, wherein said metal comprises aluminum.

6. The lead-trough device according to claim 1, said conductive layers being arranged to be formed as coatings arranged on said insulating layers.

7. The lead-trough device according to claim 6, said coatings comprising conductive paint arranged to be printed onto said insulating layers.

8. The lead-trough device according to claim 1, wherein the insulating layers are resin impregnated.

9. The lead-trough device according to claim 1, further being arranged with a test tap.

10. The lead-trough device according to claim 1, said lead-trough device being a bushing.

11. The lead-trough device according to claim 1, further being arranged such that a gap created between the two ends of a respective one of a number of conducting layers is aligned along a same transaxial direction of said insulating body.

12. The lead-trough device according to claim 1, further being arranged such that a gap created between the two ends of at least one of a number of conducting layers is not aligned along a same transaxial direction of said insulating body.

13. The lead-trough device according to claim 1, further being arranged such that at least one conducting layer is short-circuited.

* * * * *